United States Patent [19]

Faure et al.

[11] Patent Number: 4,489,540

[45] Date of Patent: Dec. 25, 1984

[54] PROCESS AND DEVICE FOR OBTAINING A SPUN YARN OF FIBRES COMPRISING AN INTERNAL CORE AND NOVEL TYPES OF SPUN YARNS THUS MADE

[75] Inventors: Jean-Louis Faure; Jean Venot, both of Roanne, France

[73] Assignee: ASA S.A., Villeurbanne, France

[21] Appl. No.: 458,702

[22] Filed: Jan. 17, 1983

[30] Foreign Application Priority Data

Jan. 26, 1982 [FR] France ..... 82 01382
Sep. 17, 1982 [FR] France ..... 82 15830

[51] Int. Cl.[3] ..... D02G 3/38

[52] U.S. Cl. ..... 57/5; 57/6; 57/328

[58] Field of Search ..... 57/3, 5, 6, 210, 224, 57/225, 226–228, 315, 328, 329, 331, 908

[56] References Cited

U.S. PATENT DOCUMENTS 3,924,396 12/1975 Bobkowicz et al. ..... 57/5
4,033,102 7/1977 Vanhelle ..... 57/12
4,209,965 7/1980 Bobkowicz ..... 57/5
4,359,856 11/1982 Bobkowicz ..... 57/5

FOREIGN PATENT DOCUMENTS 1044932 11/1953 France .
1117278 3/1956 France .
1503693 10/1967 France .
2388904 11/1978 France .
2001359 1/1979 United Kingdom .
2068025 8/1981 United Kingdom .

*Primary Examiner*—Donald Watkins
*Attorney, Agent, or Firm*—Parkhurst & Oliff

[57] ABSTRACT

The invention relates to a process and device for making a spun yarn of fibres comprising an internal core which consists in subjecting the yarn to form the core to a momentary false twist by means of a spindle and projecting elementary fibres onto this yarn. Such elementary fibres are projected by means of a mobile guide surface on which the fibres are delivered tangentially, the core likewise being displaced tangentially with respect to the guide surface in a direction concurrent with the direction of delivery of the fibres.

16 Claims, 7 Drawing Figures

PROCESS AND DEVICE FOR OBTAINING A SPUN YARN OF FIBRES COMPRISING AN INTERNAL CORE AND NOVEL TYPES OF SPUN YARNS THUS MADE

BACKGROUND OF THE INVENTION

The present invention relates to improvements in spinning techniques for making yarns of fibres comprising an internal core, which yarns will be referred to in the following specification as "core spun yarns".

Numerous techniques have been proposed for making core spun yarns. The most wide spread technique in introducing a multifilament core into a rove during the last spinning operation, i.e. on the continuous filament to be spun, in which the core being introduced downstream of the last pair of rove-stretching rollers. This solution gives good results but has the drawback of being limited in speed, taking into account the fact that the yarn obtained is received by a system communicating a twist to the yarn for example a ring and traveller winding device.

U.S. Pat. No. 4,033,102 also proposes making self-twisted yarns of which at least one of the constituents presents a core in its central part, in which the core is likewise incorporated upstream of the last pair of rollers of the system for stretching a rove of fibres. This technique makes it possible to increase the speeds of production, taking into account the fact that reception of the yarns formed does not nessitate communicating a twist thereto. On the other hand, in the twist change zones, the yarn may sometimes present defects. Moreover, taking into account the fact that the yarn formed comprises at least two constituents twisted on one another, it is relatively delicate to obtain very fine yarns.

Numerous solutions which have heretofore not experienced industrial development have also been proposed for making spun yarns. For example, it has been envisaged to project elementary fibres onto a continuous yarn subjected to a momentary false twist upstream of the false twist spindle.

It has also been proposed to project the fibres onto a core previously sized or coated with a heat-sizing material. These solutions are relatively complex to carry out and do not lead to yarns having properties comparable to the conventional spun yarns having a real twist.

SUMMARY OF THE INVENTION

Now, an improved process has been found, and it is this process which forms the subject matter of the present invention. The process is of considerable versatility in execution and allows mass production, which overcomes the drawbacks of the earlier solutions, while enabling a core spun yarn to be obtained which, after winding, presents a real twist over its length, the fibres being perfectly bonded to the internal core.

Therefore, the invention generally relates to a process for making a spun yarn of fibres comprising an internal core, said process comprising, in known manner, the following steps of:

positively delivering a yarn adapted to form the internal core, subjecting the delivered yarn to a momentary false twist, projecting elementary fibres onto this yarn, upstream of the false twist spindle, and is characterized in that:

the projection of the elementary fibres onto the core in the zone where the twist extends back is effected by means of a mobile guide surface on which the fibres are delivered tangentially and which tends to exert a pulling force on the free end of the fibres, the core is displaced tangentially with respect to the said guide surface in a direction concurrent with the direction of delivery of the fibres.

In a preferred embodiment of the process according to the invention, the mobile guide surface is subjected to the action of a stream of fluid, for example air, the flow of which is such that it promotes, in cooperation with said guide surface, the transport and condensation of the fibres. This stream of fluid may for example be obtained by subjecting the guide surface to suction or reduced pressure. Furthermore, the action of the stream of fluid, for example the effect of suction or reduced pressure, is advantageously eliminated in the vicinity of the point of junction between the fibres and the core with which they must be associated.

As a guide surface allowing the invention to be carried out, a rotary guide may for example be used, which presents on its periphery a groove for guiding the core yarn and fibres. This groove will preferably be V-sectioned, the arms of which may be more or less separated from each other. The bottom of this groove is subjected to suction or reduced pressure, the core yarn passes tangentially to the interior and the fibres adapted to be projected onto the core are delivered substantially tangentially to the bottom of the groove but upstream with respect to the point of contact of the core yarn. The suction or reduced pressure inside the groove may be obtained by providing an inner suction source, with air flowing through orifices provided in the bottom of this groove. These orifices may be disposed in different configurations, and for example may be aligned or, may be preferably, substantially in the form of a sine curve.

Of course, the guide surface may be constituted by any other equivalent means, for example by a system incorporating conveyor belts.

The device for delivering the fibres onto the guide surface may be constituted by any known device for stretching a rove of fibres, such as, for example, stretching systems incorporating sleeves, a licker-in of the type such as those used in open end spinning, devices for effecting great stretching, currently designated by the term "selector", for example of the type such as those described in French Patent Nos. 1,044,932, 1,117,278 and 1,503,693.

According to the embodiment of the invention in which the guide surface is constituted by a rotary guide (or condenser) subjected or not subjected to an internal suction or reduced pressure, the core yarn is displaced vertically from top to bottom and the rotary guide is disposed at the outlet of a conventional fibre stretching system, the latter being disposed obliquely so that the fibres are delivered at the bottom of the groove, forming an angle of about 45° with the core yarn. Of course, such an embodiment is not limiting and other paths and/or angles between the core yarn and the delivery of the fibres may be envisaged.

Moreover, the distance between the outlet point of the fibres from the member delivering them, for example between the last pair of rollers of a stretching system, and the point of contact of the fibres with the guide surface, for example with a rotary guide, will be adapted as a function of the fibres treated, but it has been observed that good results were obtained by having a distance at least equal to the mean length of the fibres which have to be associated with the core.

However, in certain particular cases resulting either from existing spinning machines which are adapted to carry out the process according to the invention, or from the very nature of the fibres treated, particularly due to their length, it may happen that it is necessary to place the rotary guide (or condenser) on which the fibres are delivered, at a certain distance, of the order of several centimeters, from the point where the fibres emerge from the conventional stretching system which delivers them.

In this case, the fibres may therefore have a relatively long open-air path which may cause difficulties in obtaining a regular yarn.

According to an improved variant, which is also the subject matter of the present invention, this drawback may be overcome by providing, between the outlet of the fibre stretching device and the guide surface, preferably constituted by a rotary condenser guide, a conveyor surface, subjected to suction or reduced pressure, and which ensures transport of the fibres from the outlet of the stretching system up to the guide surface.

According to this variant, the conveyor surface is advantageously constituted by an endless belt borne on the one hand by one of the rollers of the fibre stretching system and which, on the other hand, is virtually tangential with the guide surface on which the fibres are delivered for example with a rotary guide.

The filiform element constituting the core of a spun yarn according to the invention may be composed of any textile material of known type, for example multifilament yarns, spun yarns of fibres made either previously or directly during execution of the process of the invention, or even possibly spun yarns of fibres themselves comprising an internal core.

Finally, the spindle for communicating a false twist to the core may be constituted by any known type of spindle, for example internal or external friction spindles, belt spindles, or even pneumatic spindles.

BRIEF DESCRIPTION OF THE DRAWINGS

The invention will be more readily understood on reading the following description with reference to the accompanying drawings, in which.

DETAILED DESCRIPTION

Figure 1:
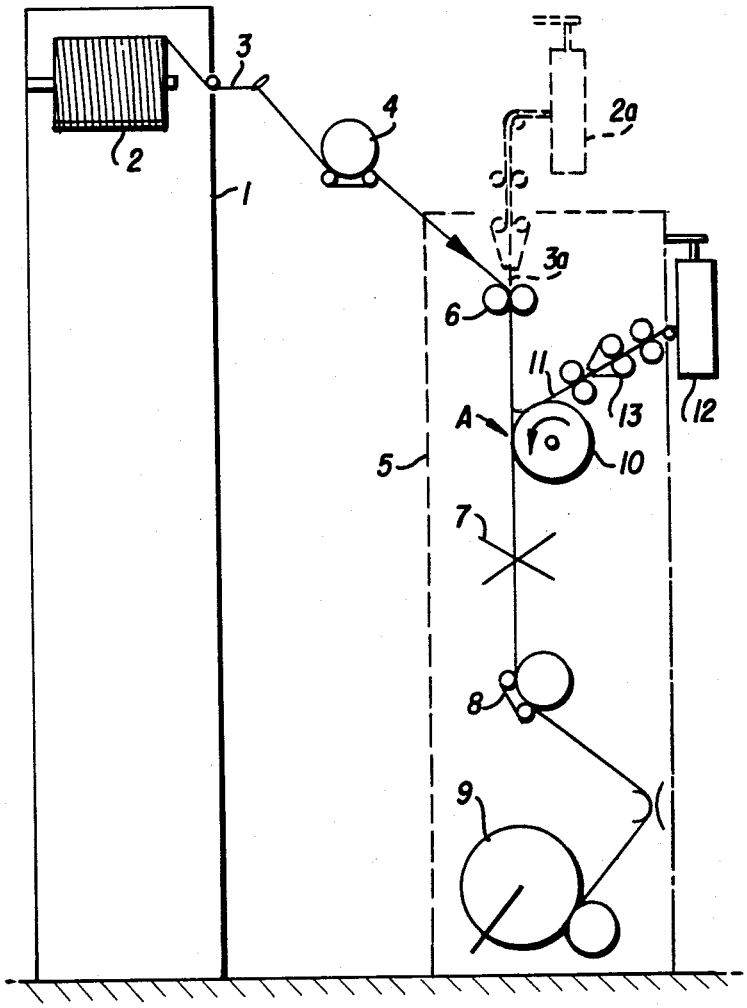
FIGS. 1 and 7 schematically illustrate, in side and perspective view, a work station of a machine according to the invention, enabling the production of a core spun yarn.
Figure 7:
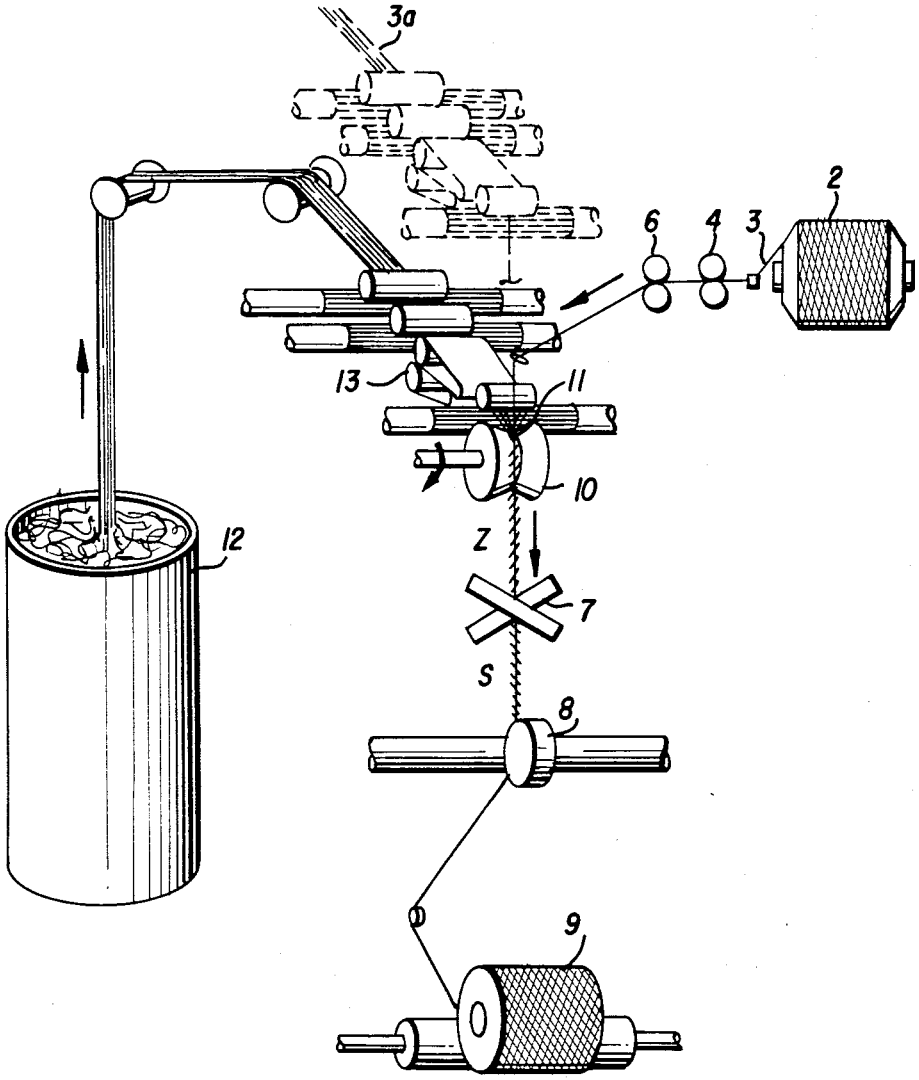

Referring now to the drawings, FIGS. 1 and 7 illustrate a work station of a machine for carrying out the process according to the invention, i.e. enabling real core spun yarns to be made in one step.

The machine comprises, a storage zone 1, for example, creels where bobbins of yarns for constituting the core of the yarn according to the invention are disposed. These yarns are delivered, by an optional delivery device 4, to the actual zone of treatment generally designated by reference numeral 5, where they will be coated and associated with discontinuous fibres.

Furthermore, if the process according to the invention is carried out by using continuous multifilament yarns as core yarn 3, it may be envisaged, as shown in broken lines in these FIGS. "1 and 7" to have a core formed by a fibre spun yarn 3*a* obtained by stretching a mesh or sliver 2*a*, this spun yarn being used either alone or possibly incorporating a multifilament core.

The zone of treatment 5 comprises, a delivery device 6, a false twist spindle 7 of known type, for example a crossed belt or friction spindle. Of course, any other type of spindle, with or without friction, may be used.

A third intake delivery device 8 is disposed downstream of the spindle 7 and the formed yarn is wound at 9 by means of a conventional system, for example the type with peripheral and reciprocating drive.

According to the invention, upstream of the false twist spindle 7, i.e. in the zone where the twist extends back, there is a mobile guide surface, constituted in the present case by a rotary guide 10, adapted to dispense discontinuous fibres 11 on the core yarn 3. These fibres 11 come from a rove 12 which undergoes a stretching, for example by means of a conventional system with sleeves 13. Of course, any other rove stretching system may be used such as for example the lickers serving to carry out the so-called open end spinning technique or systems allowing considerable stretching of the type such as described in French Patents Nos. 1,044,932, 1,117,278 and 1,503,693.

In the example illustrated in the accompanying Figures, the guide surface 10 constituted by a rotary disc is disposed downstream of the last pair of stretching rollers 14 of a stretching system incorporating sleeves 13. According to this embodiment, the rotary guide 10 presents a peripheral groove 15, as shown clearly in FIGS. 2 and 3. Furthermore, it comprises radial orifices 16 enabling suction or reduced pressure to be created inside the groove 15.

The core yarn 3 is delivered tangentially to, or at a very short distance from the bottom of the groove 15, while the fibres 11 are likewise delivered tangentially to the bottom of the groove, but by enveloping the surface of the rotary guide 10. Consequently, this rotary guide serves not only as an element for guiding and transporting the elementary fibres 11, but also as an element for distributing said elementary fibres on the core yarn 3.

Furthermore, the phenomenon of suction or reduced pressure is preferably eliminated in the vicinity of the point of contact A of the yarn 3 and the rotary guide 10, for example by means of a fixed mask 18 which obturates the orifices 16. In the present case, and to simplify matters, the mask 18 is shown in a position such that it obturates the orifices 16 substantially from the point of contact A of the core yarn, but it is obvious that this position may be modified by eliminating the phenomenon of suction or reduced pressure either before or after this point of contact A, as a function of the materials worked and/or the speeds of production.

Figure 2:
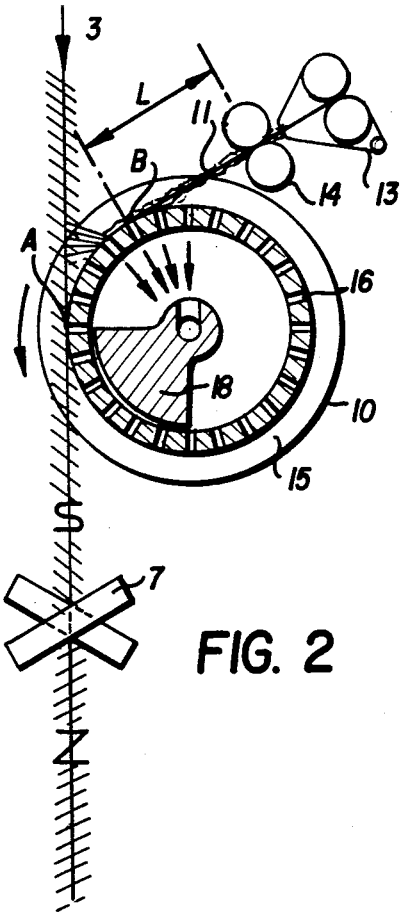
FIG. 2 is a detailed view showing more particularly an embodiment of a mobile guide surface for the fibres including a rotary guide subjected to an internal suction or reduced pressure as well as the manner in which the core yarn and the fibres are delivered on this guide.
Figure 3:
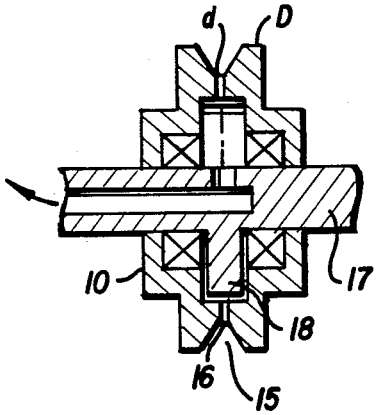
FIG. 3 is a transverse section of a guide surface in the form of rotary guide allowing the invention to be carried out.

FIGS. 2 and 3 illustrate in greater detail an embodiment of such a guide surface in the form of rotary guide. In this embodiment, the mask 18 adapted to obturate the orifices 16 is disposed inside the disc and the suction or reduced pressure inside the groove 15 is obtained by means of a source of suction (not shown), connected to an inner conduit provided in the fixed support shaft 17 of the guide 10 which opens out inside a cavity in the guide. This guide 10 is mounted on bearings and is rotated for example by means of a tangential belt (not shown). Of course, other embodiments may be envisaged without departing from the scope of the invention.

Moreover, as has been stated hereinabove, the distance L between the last pair of rollers 14 of the stretching system 13 and the point of contact B of fibres 11 with the bottom of the groove 15 is adjusted so as to be at least equal to the mean length of the fibres 11.

It has been observed that it was possible, due to such a process, to obtain core spun yarns in which not only the peripheral fibres are perfectly bonded to the internal core, but they also present a real twist about this core. Moreover, the yarns thus produced present very good textile characteristics and are obtainable at high speeds, which may reach several hundreds of meters per minute, taking into account the fact that winding may be effected without communicating twist.

Figure 4:
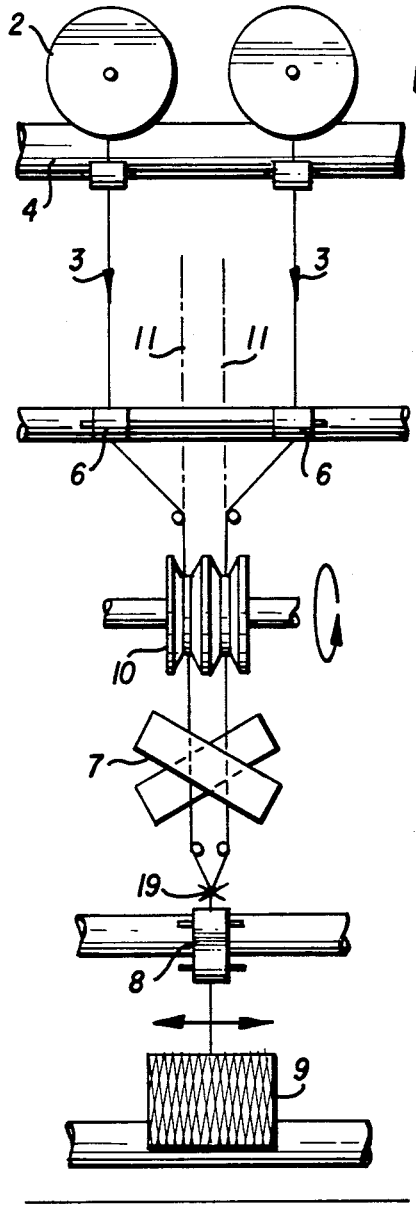
FIG. 4 schematically illustrates, in front view, the obtaining of a yarn comprising two core spun yarns made according to the invention.

Not only does such a process enable single yarns to be obtained, but it may also be adapted, as illustrated in FIG. 4 to obtain double yarns. To this end, it suffices to supply in parallel two elementary yarns 3 inside the false twist spindle 7 and to deliver fibres on each of these yarns 3, for example, by means of a rotary guide 10 comprising two peripheral grooves 15, each being subjected to internal suction or reduced pressure. The assembly of the two core yarns obtained is effected by a simple joining guide 19, the assembled yarn being delivered to the winding means 9 by a common delivery device 8.

It may also be envisaged to adapt this technique to obtaining self-twisted yarns, by providing downstream of the rotary guide a conventional system enabling an alternate twist to be communicated by providing the self-twist in conventional manner. An installation of the type illustrated in FIG. 4 may be used, for example, with an intermittent delivery device being disposed between the rotary guides 10 and the false twist spindle 7.

EXAMPLE 1

On an installation as illustrated in FIGS. 1, 2 and 3, a core yarn according to the invention is made under the following conditions:

- core yarn 3: polyester yarn of 72 decitex per 33 strands,
- intake speed of the core yarn 3 (delivery devices 4 and 6): 200 m/min,
- false twist spindle 7: spindle with crossed belts forming therebetween an angle of 46° and having a linear speed of 540 m/min,
- roves of fibres 12: cotton (Nm3)
- stretching at 13: 30 times
- distance L: 40 mm
- angle between the yarn 3 and delivery of the fibres 11: about 45°,
- rotary guide 10: outer diameter D 70 mm - diameter at gottom of groove d: 50 mm
- orifices 16: 72 in number, with a diameter of 0.8 mm,
- internal suction or reduced pressure: about 200 mm water.

By proceeding under the conditions indicated above, a core yarn is obtained having a count of 185 decitex, with the wool fibres being perfectly bonded to the core 14 and covering this latter article regularly.

Such a yarn may be used as such in weaving or hosiery.

EXAMPLE 2

Example 1 is repeated except that the procedure is as illustrated in FIG. 4, i.e. two yarns are treated simultaneously and then joined downstream of the false twist spindle 7.

An assembled yarn is obtained which, although no twist is communicated by the winding system 9, still presents a certain cohesion, probably due to the hooking of the fibres to one another. Such a yarn with a total count of 370 decitex may also be used as such in weaving or hosiery.

EXAMPLE 3

Example 1 is repeated, but the multifilament core 3 is replaced by a rove 3*a* stretched directly on the machine as shown in broken lines in FIG. 1. The rove 3*a* is a rove of cotton, of Nm 3 before stretching which is stretched 30 times on the machine.

In this way, a spun yarn of fibres is obtained, comprising an external sheath constituted by the fibres 11, which are twisted about a core also constituted by discontinuous fibres substantially at zero twist.

Such a yarn may also be used both in weaving and in hosiery.

Of course, the invention is not limited to the embodiments given hereinabove, but covers all the variants thereof in the same spirit.

Figure 5:
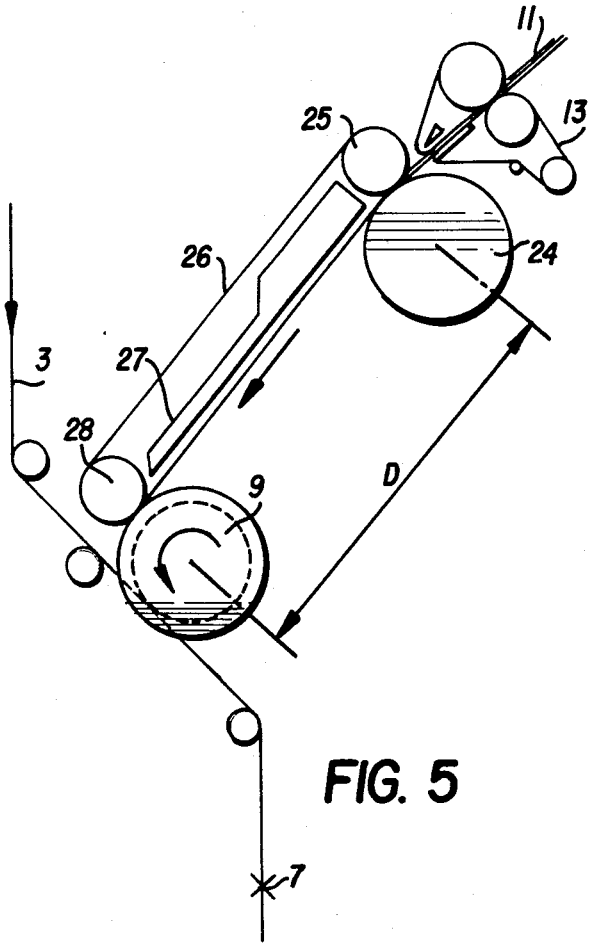
FIG. 5 illustrates a variant according to the invention, in which the transport of the fibres between the outlet of the conventional stretching system and the mobile guide surface (rotary guide) allowing fibres to be projected on the core is obtained by providing, in addition to these elements, a conveyor surface subjected to suction or reduced pressure.

For example, FIG. 5 illustrates a variant according to the invention in which the same references have been used for denoting the same elements as in the previous examples.

Figure 6:
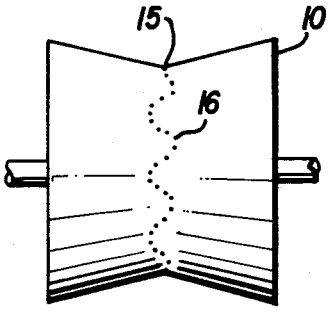
FIG. 6 is a front view illustrating a variant of a guide surface in the form of rotary guide for carrying out the invention.

According to this variant, the stretching system comprises two sleeves 13 at the outlet of which are disposed a selector roller 24 associated with a presser roller 25. The rove of fibres 11 is stretched between these elements and, according to this variant, the roller 25 is associated with a conveyor belt 26 constituted by a perforated belt inside of which is disposed a suction member 27. The belt 26, supported at its end by a support roller 28, is virtually tangential to the rotary condenser guide 10 which performs the role of the mobile guide surface and which, in the present case, is made according to the example illustrated in FIG. 6. This guide 10, as before, tends to exert a pulling force on the free end of the fibres 11.

With respect to the earlier examples, this rotary condenser guide presents on its periphery a groove 15 having the form of a V of which the arms are widely spaced apart. Perforations 16 are made in the bottom of this groove and are disposed substantially in the form of a sine curve. Suction is created inside the rotary guide by any appropriate means (not shown), for example in a manner similar to the example illustrated in FIGS. 2 and 3.

As before, the fibres 11 are distributed virtually tangentially to the bottom of the groove 15, in the present case, due to the conveyor belt 26. In this embodiment, the core yarn 3 is delivered, likewise tangentially to the bottom of the groove 15 and downstream of the point of projection of the fibres 11, the bond of said fibres with the core 3 being obtained due to the action of the false twist spindle 7.

The yarn obtained is wound in a conventional manner.

With respect to the embodiments described hereinbefore, such a variant ensures improved maintenance of the fibres at the outlet of the rove stretching system 11, particularly in the case of the guide surface 10, for example, a rotary condenser guide, being relatively remote from the outlet of the stretching system. Moreover, in certain cases, the conveyor belt 26 incorporating suction makes it possible to improve the quality of the yarns obtained in that it promotes parallelization of the fibres and in certain cases, even ensures additional stretching. In addition, due to such an embodiment, the passage of the fibres in the open air may be very short, and adjusted so that it is shorter than the mean length of said fibres, which may enable very short fibres, such as carded cotton, to be treated.

Of course, the invention is not limited to the embodiments described hereinbefore, but covers all the variants made in the same spirit.

For example, it may be envisaged to apply this process in combination with any known process for making novelty yarns, for example, by varying the speed of supply and/or the speed of winding, by associating the core yarn formed with additional yarns. Similarly, it may be envisaged to use non-stretched core yarns 3, with stretching being effected between the delivery devices 4 and 6, and it may be possible to produce a real texturized core continuously by providing a conventional oven between the rotary guide 10 and the delivery device 6.

Of course, if the invention is particularly adapted to allow winding without additional twist, it may be envisaged to give the yarns formed, a complementary twist, for example by using a ring and traveller winding system.

Moreover, in the examples given hereinbefore in which, the core yarn is displaced vertically from top to bottom it is obvious that this is not limiting and that the path of the yarn may be modified so that the displacement of the core yarn is from bottom to top or even horizontal.

Finally, if the supply of fibres may be effected from a rove, it is obvious, as shown in FIG. 7, that other types of supply materials may be used, for example slivers of pot.

What is claimed is:

1. A process for making a spun yarn of fibres comprising an internal core, comprising the steps of:

(a) positively delivering a yarn forming an internal core, (b) subjecting said core yarn to a momentary false twist, (c) projecting elementary fibres onto said core yarn, upstream of a false twist spindle, wherein:

the projection of said elementary fibres onto said core yarn is effected by means of a mobile guide surface on which said fibres are delivered tangentially and which tends to exert a pulling force on the free end of said fibres, and said core yarn is displaced tangentially with respect to said guide surface in a direction concurrent with the direction of delivery of the fibres.

2. The process of claim 1, wherein said guide surface is subjected to the action of a stream of fluid.

3. The process of claim 2, wherein said stream of fluid is obtained by subjecting said guide surface to a suction.

4. The process of claim 3, wherein said guide surface comprises a rotary guide having a groove on its periphery for guiding said core yarn and said fibres, the bottom of said groove being subjected to suction, said core yarn passing tangentially to the interior of said groove, and said fibres being delivered tangentially to the bottom of said groove upstream of the point of contact of said core yarn enveloping said rotary guide over a portion of its periphery.

5. The process of claim 4, wherein perforations disposed substantially in the form of a sine curve are disposed in the bottom of said groove.

6. The process of claim 4, wherein the effect of suction is eliminated at the point of contact of said core yarn with said guide surface.

7. The process of claim 4, wherein said core yarn is displaced substantially vertically and said rotary guide is disposed at the outlet of a stretching system, said stretching system delivering said fibers and being disposed so that said fibres are delivered at the bottom of said groove forming an angle with said core yarn.

8. The process of claim 7, wherein the angle formed by the core yarn and the direction of delivery of said fibres is about 45°.

9. The process of claim 1, wherein said core yarn is a multifilament continuous yarn.

10. The process of claim 1, wherein said core yarn comprises a spun yarn of fibres made during said process.

11. The process of claim 1, wherein the core yarn is constituted by a spun yarn of fibres itself comprising an additional core.

12. The process of claim 1 further comprising, providing two yarns with elementary fibres projected thereon and joining said two yarns by winding means.

13. The process of claim 1, wherein a conveyor surface subjected to suction is disposed between the outlet of a rove stretching system and said mobile guide surface on which said fibres are tangentially delivered.

14. A device for carrying out the process of claim 1, which comprises, a storage area having bobbins of core yarn disposed therein, a yarn delivery device delivering yarn to a treatment zone, the treatment zone comprising a delivery device, a false twist spindle, an intake delivery device and winding means, wherein, a mobile guide surface distributing discontinuous fibres onto said core yarn is disposed upstream of said false twist spindle, said fibres being delivered from a rove of fibres subjected to stretching by means of a stretching system and said mobile guide surface exerting a pulling force on the free end of said fibres, said core yarn being displaced tangentially with respect to said guide surface by said delivery device, said false twist spindle and said intake delivery device, in a direction concurrent with the direction of delivery of said fibres.

15. The device of claim 14, wherein said mobile guide surface comprises a rotary condenser guide having a peripheral groove subjected to suction.

16. The process of claim 2, wherein said stream of fluid is obtained by subjecting said guide surface to reduced pressure.

* * * * *